United States Patent [19]

Prestholdt

[11] 4,179,700

[45] Dec. 18, 1979

[54] METHOD AND APPARATUS FOR CONTROLLING ELECTROMAGNETIC RERADIATION FROM AN ELECTRICALLY CONDUCTING STRUCTURE

[76] Inventor: Ogden L. Prestholdt, 8905 Maxwell Dr., Potomac, Md. 20854

[21] Appl. No.: 852,453

[22] Filed: Nov. 17, 1977

[51] Int. Cl.[2] ..... H01Q 1/52

[52] U.S. Cl. ..... 343/885; 343/787

[58] Field of Search ..... 343/787, 885; 174/208

[56] References Cited

U.S. PATENT DOCUMENTS 2,594,890 8/1978 Ellwood ..... 333/79

FOREIGN PATENT DOCUMENTS 1264541 3/1968 Fed. Rep. of Germany ..... 343/885

2143199 3/1973 Fed. Rep. of Germany ..... 343/885

*Primary Examiner*—Eli Lieberman

*Attorney, Agent, or Firm*—Fleit & Jacobson

[57] ABSTRACT

A method and apparatus for controlling reradiation from conductors, such as guy wires, by controlling the current distribution on the conductors, is provided. The invention comprises a cylindrical annular shaped sleeve that is positioned at predetermined distances along an electrically conducting structure to eliminate the reradiation caused by electromagnetic waves. The sleeve is made of a high magnetic permeability material, and a plurality of sleeves is positioned at predetermined spaced-apart distances along the conductor. The predetermined positioning of the sleeve renders the conductor electrically equivalent to a plurality of discrete cable lengths separated by insulators.

10 Claims, 8 Drawing Figures

METHOD AND APPARATUS FOR CONTROLLING ELECTROMAGNETIC RERADIATION FROM AN ELECTRICALLY CONDUCTING STRUCTURE

BACKGROUND AND SUMMARY OF THE INVENTION

The present invention relates to a means of controlling reradiation, or reflection, from electrically conducting structures, such as linear conductors in the form of cable guy wires, by controlling the current distribution on the conductors by means of inductive effects resulting from the use of high magnetic permeability sleeve-like materials.

The present invention further provides a means of controlling the amplitude and phase distribution of an electromagnetic current on certain conductors by the appropriate location of suitably-sized high magnetic permeability cylindrical sleeves surrounding the conductor.

When electromagnetic radiation, such as from AM radio antennae, or directional antennae, occurs, the electromagnetic radiation emitted by the antennae may be adversely affected by tall towers, such as television towers, that are positioned nearby. For example, cable guy wires are used to support such tall towers. The electromagnetic radiation incident upon the tower will generate currents that flow within such cable guy wires. Undesirable currents can flow not only in the cable guy wires that support the tall towers, but in the tall tower structure itself. These currents result in reradiation or reflection of the incident electromagnetic radiation.

It is known in the art to eliminate the undesirable reradiation caused by the guy wires, or other conducting cables, by dividing the cable into shorter segments by means of insulators that separate the cable segments to reduce the current flow in each section. The effect of the insulators, however, is to provide a capacitance between the various cable segments, and thus the current is not completely open circuited through the conductor.

In order to further reduce the current distribution along a cable that is electrically conductive, it is known to provide an inductance in parallel with the capacitance caused by the insulators so that the net impedance between adjacent cable segments will be very large. The concept of dividing a support cable into a plurality of cable segments separated by insulators and, by providing inductors in parallel with the insulators, has been suggested by Dr. Andrew Alford and is disclosed in application Ser. Nos. 808,290, filed on June 20, 1977, now abandoned and 813,763 filed on July 7, 1977. Dr. Alford has suggested that for specific lengths of cable segments, a current distribution can be achieved which will result in very small, nearly zero, reradiation in the equatorial plane back toward the original electromagnetic source.

The present invention comprises an improvement over the prior art methods of dividing a cable support element, such as a guy wire for tall towers, into segments, with insulators interconnecting the segments and with inductive elements connected in parallel across the insulators. In particular, it is an object of the present invention to provide a means for minimizing reradiation, or reflection, in electrical conductors, such as guy wires or the like, without dividing the guy wires into separate discrete cable segments.

It is further an object of this invention to provide for a new and unique method and apparatus for eliminating reflection, or reradiation, caused by electrically conducting structures, such as cable guy wires, by providing sleeve-like high permeability materials spaced at predetermined distances along the cable guy wire without interrupting the cable guy wire.

It is a further object of the present invention to provide a method and apparatus comprising a sleeve of high magnetic permeability material having an annular cylindrical shape and a specific predetermined length, such that by proper positioning of the sleeve around the cable guy wires, reradiation, or reflection, at a particular electromagnetic radiation frequency can be optimally reduced. In particular, it is an object of the present invention to position the sleeves at particular spaced-apart distances along the guy wire, or other electrical conducting structure, such that the structure approximates, in terms of its electrical characteristic, a structure having a plurality of cable segments interconnected by insulators with inductors connected in parallel across the insulators. The present invention, however, does not require that the cable guy wire be physically separated into shorter cable segments with insulators interconnected therebetween. Thus, the present invention provides for an inexpensive and relatively simple method of retrofitting existing cable guy wire support structures.

These and other objects of the invention will be apparent to one of ordinary skill in the art from reading the following disclosure.

DETAILED DESCRIPTION OF THE DRAWINGS

Figure 1:
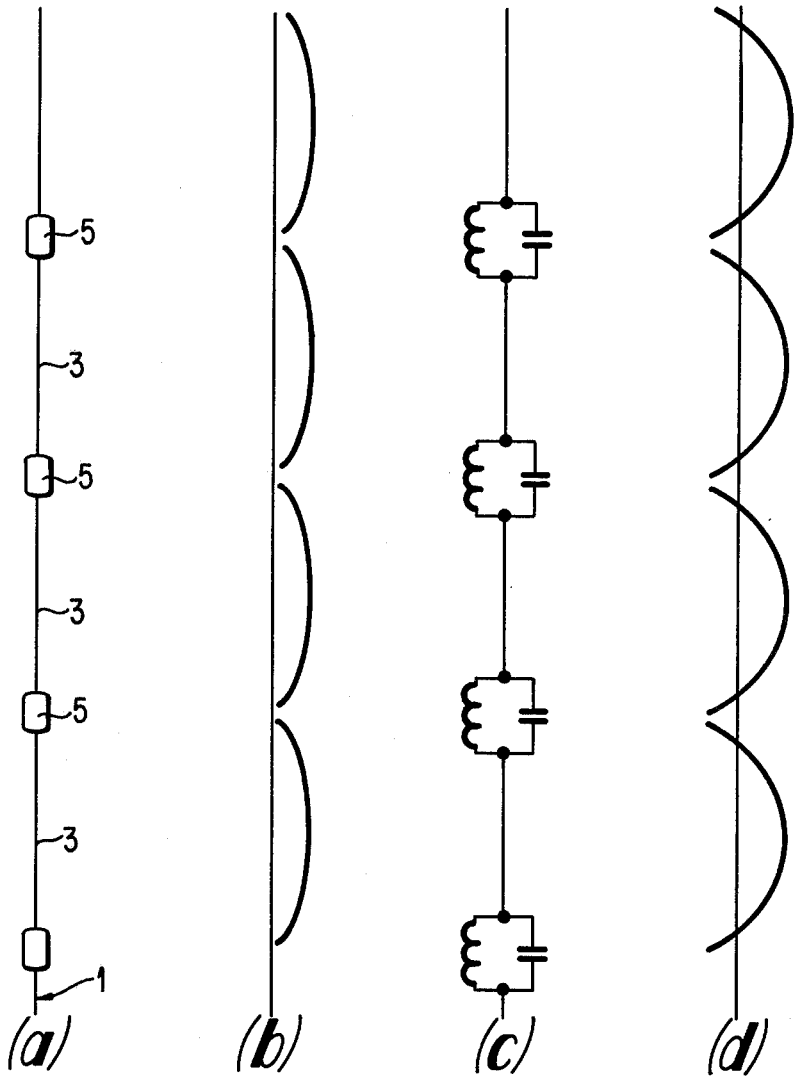
FIGS. 1(*a*)–(*d*) depict the basis for a theoretical analysis of the present invention.

FIG. 1 of the drawings depicts the theoretical concept underlying the present invention. Referring to FIG. 1(*a*), a conducting structure, such as a cable guy wire support structure is depicted as element 1. This conductor is typically of several electromagnetic wavelengths in length, although conductors less than a wavelength may be treated in a similar fashion. It has been conventional to minimize reradiation from such a conductor by dividing the conducting cable into shorter segments 3 by means of insulators 5, in order to reduce the current in each section, and to prevent current from flowing through the entire length of the cable. The resulting current distribution along such a cable, which is broken up into segments by means of insulators, is depicted in FIG. 1(*b*), assuming the electrical vector of the electromagnetic field is parallel to the cable orientation. The current distribution along each single segment is seen to approximate that of a cosine function distribution wherein the amplitude is proportional to the cosine of the distance from the center of the cable segment, i.e., from the midpoint between the insulators. If the angular relationship between the electrical field vector and the cable is other than parallel, then the current distribution becomes skewed, however, the principal remains the same. Because of the coupling insulator 5 between adjacent cable segments 3, which results in a capacitance across the insulator 5, the current in the cable adjacent the insulator does not go precisely to zero.

If, however, an inductive coil were placed across each insulator, as schematically indicated in FIG. 1(*c*), the effect of capacitance of the insulator can be reduced. This reduction in capacitance causes a reduction in the magnitude of the current flowing in the segment, and can be made to reduce the current flowing in all parts of the cable segment. If the size of the coil were chosen so that its reactance at the operating frequency is equal to that of the capacitor, a very high impedance is placed between adjacent cable segments and the current in the cable segment adjacent to the insulator would be very small. If the inductive reactance were made even smaller, the net reactance will be inductive and the current in the cable near the insulator would suffer a change in phase, as depicted in FIG. 1(*d*). For specific lengths of cable segments and specific values of inductance between cable segments, a current distribution can be achieved which, because of the phase reversal mentioned above, will result in very small, nearly zero, reradiation in the equatorial plane back toward the original source.

Figure 2:
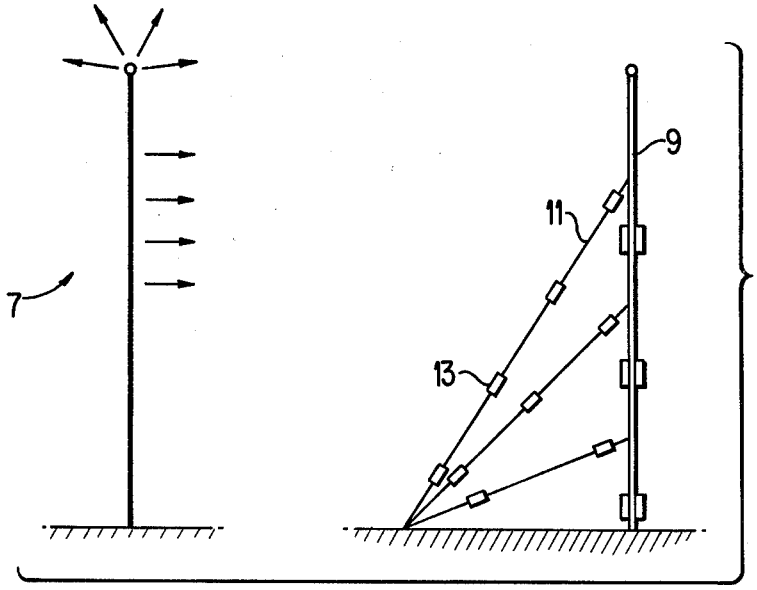
FIG. 2 discloses a source of electromagnetic radiation and a tower supported by guy wires with the sleeve apparatus positioned along the guy wire and the tower to minimize reradiation.

The present invention seeks to likewise reduce the amount of reradiation in a cable length, caused by current flow in the cable, but without breaking the cable into shorter segments. Referring to FIG. 2, a source of electromagnetic radiation 7 is depicted. This source can be a conventional AM radio antenna, or any directional antenna. If the antenna 7 were positioned in close proximity to a tall structure, such as a television antenna 9 having conductive cable guy wire supports 11, the conductive cable guy wire supports 11, as well as the tower 9 itself, will cause reradiation as a result of currents that flow within the conducting structures 9 and 11. However, by suitably positioning sleeves 13 of high magnetic permeability material having a specific size, and spaced at a specific distance adjacent to each other, the guy wires 11 can exhibit the same electrical characteristics as a similar guy wire 11, wherein the guy wire is broken up into a plurality of smaller segments separated by insulators and inductors. That is, the positioning of the sleeves 13 provides the effect of a lumped inductance at specific points along the cable length.

Figure 3:
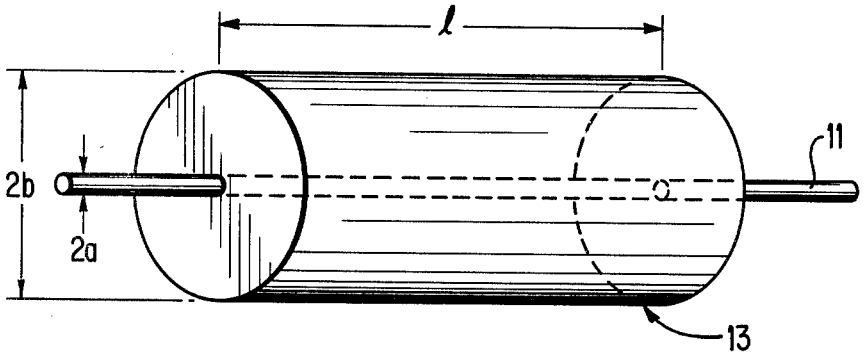
FIG. 3 shows the particular sleeve construction.

FIG. 3 depicts a specific sleeve shape. The sleeve 13 is made of a high magnetic permeability material, such as a ferromagnetic material. Preferably, the permeability is greater than 30. However, depending upon the particular frequency for which the system is designed, and dependent upon the structure and shape of the sleeve and conducting structure that is to be detuned, permeabilities below 30 may be employed. In addition, a high magnetic permeability material must be selected such that the material does not become too easily saturated at the particular power levels that are involved resulting in heat loss. It is known that the permeability of a material becomes reduced with increased saturation. Thus, it is desirable to select the material such that the loss of the material is relatively low, i.e., the resistance within the material is relatively low, for the particular power level, i.e., electromagnetic frequency, that the sleeve is designed to effect. If the resistance of the material becomes too high, the permeability is adversely affected. Thus, any high permeability material having a relatively low loss at the particular power level involved can be successfully employed in the present invention.

The specific dimensions of the sleeve are critical to optimize the desired reradiation effect. For example, when an annular cylindrical sleeve is positioned surrounding an electrical conducting structure, such as a cable guy wire support 11 having a radius of a, the inner radius of the annular sleeve is equal to a, the outer radius of the annular sleeve is equal to b and the length of the sleeve is 1. The inductance L of such a sleeve satisfies the following equation:

$$L = 0.002\,l\left[\ln_e \frac{2lb^{(\mu-1)}}{a^{\mu}} - 1\right]\mu h,$$

where $\mu$ is the magnetic permeability of the sleeve.

Figure 4:
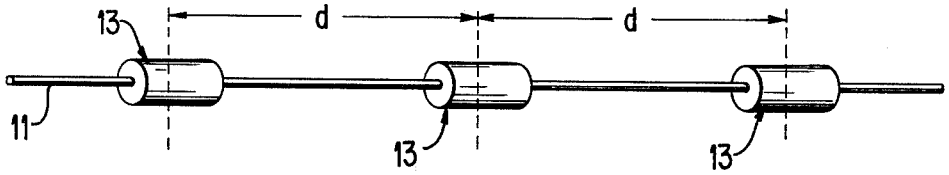
FIG. 4 show the placement of the sleeves at predetermined spaced-apart distances along the conductor length.

As shown in FIG. 4, the sleeves are positioned surrounding the guy wire 11 at a predetermined spaced-apart distance d. The distance d is shown as the distance between the mid-points of the sleeve. However, d could also be between opposing end faces of the sleeves. Since d is generally much greater than the length of the sleeves *l*, exactness is not strictly required. The distance d is determined by the following equation:

$$\tan \frac{\pi d}{\lambda} \geqq \frac{2Z_o}{x}$$

where $Z_o$ is the characteristic impedance of the length d between adjacent sleeves and is equal to $60\ln_e d/2a$ and $x=2\lambda fL$, where $\lambda$ and f are the wavelength and frequency, respectively, of the incident electromagnetic wave.

Figure 5:
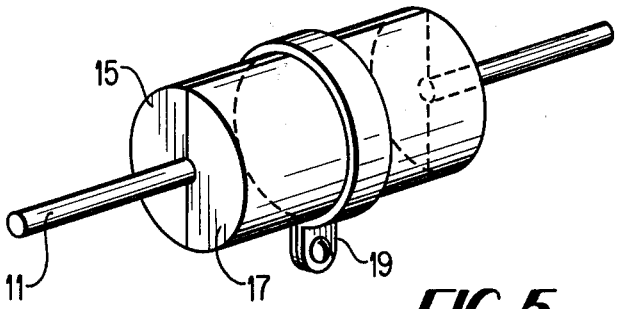
FIG. 5 shows a particular embodiment of the sleeve comprising two semicylindrical annular segments with a cable clamp structure surrounding the sleeve.

FIG. 5 discloses the particular type of cylindrically shaped sleeve that can be employed. The sleeve can be in two semicylindrical pieces 15 and 17. That is, the cylinder is cut in a plane along the major axis of the cylinder. The two sleeve halves can then be positioned surrounding the cable guy wire conductor 11, and joined by any suitable means. As shown in the drawings, a clamp 19 can be positioned around the joined cylindrical halves and secured to maintain the sleeve halves in surrounding engagement with the guy wire 11. Alternatively, the sleeves can be joined to the guy wire by epoxy, or other suitable means.

It should be pointed out that, although the sleeve is depicted in the drawings as being cylindrical, other shapes can be successfully employed. For example, the sleeve can be a prism shaped in a rectangular configuration wherein the cross-sectional shape of the sleeve is square or rectangular. In determining the length and size dimensions for such a noncircular cross-sectional prism, one determines the cross-sectional area, and then calculates an equivalent inner and outer radius depending on the area. Calculations are then based upon an equivalent cylindrical sleeve and the prism can be designed to approximate the cylindrical shape.

Likewise, the sleeve 13 can be designed to surround portions of the tower 9. For example, the tower 9 may have L-shaped angle-iron legs, and a suitable sleeve structure can be designed to surround such irregularly-shaped conducting elements. In determining the shape of such an irregularly-shaped sleeve, the conducting element's cross-sectional area is determined and an equivalent radius is determined based upon that cross-sectional area. The calculations are then carried out based upon the equivalent radius and a sleeve is designed to approximate a cylindrical prism.

Further, the inner radius of the sleeve need not be identical to the radius of the conducting guy wire 11. The sleeve can be somewhat loose fitting on the cable, secured by stop elements at either end to prevent the sleeve from sliding down the wire 11. In determining the dimensions of said sleeve, one must then consider the inductive effect caused both by the permeability of the sleeve, and the permeability of the environment between the inner surface of the sleeve and the cable guy wire.

It is the intent of the present invention not be limited to the embodiment illustrated, but only as defined in the appended claims.

I claim:

1. Apparatus for controlling electromagnetic reradiation of electrically conducting structures wherein the reradiation is caused by current flow in said structures from an electromagnetic field radiated in space from a primary source at a spaced distance from the said structure, wherein said structure has a cross-sectional equivalent radius a interfering with electromagnetic radiation of a wavelength λ (meters), comprising an annular prism-shaped sleeve of high magnetic permeability material $\mu$, said sleeve having a length $l$ (cm), a cross-sectional equivalent outer radius b (cm), a cross-sectional equivalent inner radius a (cm), wherein the inductance L (microhenries) of said sleeve is, $$L = 0.002l[\ln_e \frac{2lb^{(\mu-1)}}{a^{\mu}} - 1],$$

means for positioning a plurality of said sleeves about said electrically conducting structure at a spaced-apart distance d such that $$\tan \frac{\pi d}{\lambda} \geqq \frac{2Z_o}{x}$$

where $Z_o$ is the characteristic impedance of the structure between adjacent sleeves and $$Z_o = 60 \ln_e \frac{d}{2a},$$

and $$x = 2\pi fL$$

where f is the frequency of the electromagnetic radiation wherein the current flow in said structure undergoes a phase reversal such that the current in said structure near the sleeves is substantially reversed in phase from the current in said structure substantially midway between adjacent sleeves.

2. The apparatus of claim 1 wherein said electrically conducting structures comprises cables.

3. The apparatus of claim 2 wherein each of said cables comprise a guy wire supporting cable for supporting a tower.

4. The apparatus of claim 1 wherein said magnetic permeability of said sleeve is greater than 30.

5. The apparatus of claim 4 wherein said sleeve is of a low-loss material such that the electrical resistance of said sleeve does not substantially affect the permeability of said sleeve.

6. The apparatus of claim 5 wherein said sleeve is of a ferromagnetic material.

7. The apparatus of claim 1 wherein said sleeve is cylindrical in shape.

8. The apparatus of claim 7 wherein said sleeve comprises two portions, each portion having a semicylindrical shape, and means for securing each portion about said electrically conducting structure.

9. A method for reducing electromagnetic reradiation caused by electrically conducting structures in an electromagnetic field of a wavelength λ and a frequency f wherein the reradiation is caused by current flow in said structures from an electromagnetic field radiated in space from a primary source at a spaced distance from the said structure, wherein the electrically conducting structure has a cross-sectional area such that its equivalent cross-sectional radius is a, comprising the steps of providing an annular prism-shaped sleeve of high magnetic permeability material $\mu$, positioning a plurality of said sleeves around said electrically conductive structure at a predetermined spaced-apart distance d such that the electromagnetic reradiation from said structure is substantially eliminated, and wherein the current flow in said structure undergoes a phase reversal such that the current in said structure near the sleeves is substantially reversed in phase from the current in said structure substantially midway between adjacent sleeves.

10. A method as claimed in claim 9 wherein the step of providing an annular prismatic sleeve comprises providing a sleeve of length $l$ (cm), a cross-sectional equivalent inner radius a (cm), a cross-sectional equivalent outer radius b (cm), wherein the inductance L (microhenries) is $$L = 0.002l[\ln_e \frac{2lb^{(\mu-1)}}{a^{\mu}} - 1],$$

and wherein said positioning step comprises positioning said sleeves around said electrically conductive structure at a predetermined spaced-apart distance d such that $$\tan \frac{\pi d}{\lambda} \geqq \frac{2Z_o}{x}$$

wherein $Z_o$ is the characteristic impedance of the structure between adjacent sleeves and $Z_o = 60\ln_e(d/2a)$ and $x = 2\lambda fL$.

* * * * *